US009826596B2

(12) United States Patent
Hussain et al.

(10) Patent No.: US 9,826,596 B2
(45) Date of Patent: Nov. 21, 2017

(54) DEVICES AND METHODS FOR CONTROLLING BRIGHTNESS OF A DISPLAY BACKLIGHT

(71) Applicant: APPLE INC., Cupertino, CA (US)

(72) Inventors: Asif Hussain, San Jose, CA (US); Jingdong Chen, San Jose, CA (US); Manisha P. Pandya, Sunnyvale, CA (US); Adrian E. Sun, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 1104 days.

(21) Appl. No.: 13/679,781

(22) Filed: Nov. 16, 2012

(65) Prior Publication Data

US 2014/0097765 A1 Apr. 10, 2014

Related U.S. Application Data

(60) Provisional application No. 61/710,115, filed on Oct. 5, 2012.

(51) Int. Cl.

| | |
|---|---|
| ***H05B 37/00*** | (2006.01) |
| ***H05B 37/02*** | (2006.01) |
| ***H05B 33/08*** | (2006.01) |
| ***G09G 3/34*** | (2006.01) |

(52) U.S. Cl.

CPC ..... *H05B 37/02* (2013.01); *G09G 3/3426* (2013.01); *H05B 33/0869* (2013.01)

(58) Field of Classification Search

CPC ..... G09G 2320/0646; G09G 2360/16; G09G 3/3426; G09G 2320/0285; G09G 2320/064; G09G 3/3413; G09G 3/342; G09G 3/3611; G09G 2320/0276; G09G 2320/0242; G09G 2330/021; G09G 3/2081; G09G 3/3406;

(Continued)

(56) References Cited

U.S. PATENT DOCUMENTS

2008/0180385 A1* 7/2008 Yoshida ..... G09G 3/20 345/102
2008/0284721 A1* 11/2008 Hasegawa ..... G09G 3/3406 345/102
2009/0251400 A1 10/2009 Liu et al.

(Continued)

FOREIGN PATENT DOCUMENTS

EP 2355082 A1 8/2011

*Primary Examiner* — Monica C King
(74) *Attorney, Agent, or Firm* — Fletcher Yoder PC

(57) ABSTRACT

Devices and methods for controlling brightness of a display backlight are provided. A display backlight controller may control the brightness of the display backlight by changing a duty cycle of a PWM signal that drives the LED current. However, because of LED efficacy and response time, the final output brightness (NITS) may not be linear between 0% to 100%. The disclosed methods may be used to correct the brightness using a predetermined correction factor. Further, the minimum and maximum duty cycle of the output dimming duty cycle may be limited or corrected. In one example, a backlight controller receives an input duty cycle and determines a product of the input duty cycle and a maximum duty cycle to produce a reduced duty cycle. Moreover, the backlight driver may determine a corrected duty cycle using the correction factor. The final output duty cycle and LED current may then be determined.

19 Claims, 11 Drawing Sheets

190

| ZONE (192) | DUTY CYCLE (194) | CORRECTION FACTOR (196) |
|---|---|---|
| 1 | 90-100% | 0.997 |
| 2 | 80-90% | 0.993 |
| 3 | 70-80% | 0.990 |
| 4 | 60-70% | 0.987 |
| 5 | 50-60% | 0.983 |
| 6 | 40-50% | 0.980 |
| 7 | 30-40% | 0.977 |
| 8 | 20-30% | 0.977 |
| 9 | 10-20% | 0.973 |
| 10 | 5-10% | 0.980 |
| 11 | 4-5% | 1.007 |
| 12 | 3-4% | 1.010 |
| 13 | 2-3% | 1.020 |
| 14 | 1.8-2.0% | 1.023 |
| 15 | 1.6-1.8% | 1.027 |
| 16 | 1.4-1.6% | 1.033 |
| 17 | 1.2-1.4% | 1.043 |
| 18 | 1.0-1.2% | 1.057 |
| 19 | 0.8-1.0% | 1.085 |
| 20 | 0.0-0.8% | 1.090 |

(58) Field of Classification Search
CPC ..... G09G 3/3607; G09G 2300/0452; G09G 2310/0235; G09G 2320/0247
See application file for complete search history.

(56) References Cited

U.S. PATENT DOCUMENTS

| | | | | |
|---|---|---|---|---|
| 2009/0251440 | A1 | 10/2009 | Edgecomb et al. | |
| 2011/0273488 | A1 | 11/2011 | Fujiwara et al. | |
| 2011/0279482 | A1 | 11/2011 | Neal | |
| 2012/0044277 | A1 | 2/2012 | Adachi | |
| 2012/0287168 | A1* | 11/2012 | Botzas ..... | G09G 3/3413 345/690 |

* cited by examiner

190

| ZONE (192) | DUTY CYCLE (194) | CORRECTION FACTOR (196) |
|---|---|---|
| 1 | 90-100% | 0.997 |
| 2 | 80-90% | 0.993 |
| 3 | 70-80% | 0.990 |
| 4 | 60-70% | 0.987 |
| 5 | 50-60% | 0.983 |
| 6 | 40-50% | 0.980 |
| 7 | 30-40% | 0.977 |
| 8 | 20-30% | 0.977 |
| 9 | 10-20% | 0.973 |
| 10 | 5-10% | 0.980 |
| 11 | 4-5% | 1.007 |
| 12 | 3-4% | 1.010 |
| 13 | 2-3% | 1.020 |
| 14 | 1.8-2.0% | 1.023 |
| 15 | 1.6-1.8% | 1.027 |
| 16 | 1.4-1.6% | 1.033 |
| 17 | 1.2-1.4% | 1.043 |
| 18 | 1.0-1.2% | 1.057 |
| 19 | 0.8-1.0% | 1.085 |
| 20 | 0.0-0.8% | 1.090 |

FIG. 10

DEVICES AND METHODS FOR CONTROLLING BRIGHTNESS OF A DISPLAY BACKLIGHT

CROSS REFERENCE TO RELATED APPLICATIONS

This application is a Non-Provisional Patent Application of U.S. Provisional Patent Application No. 61/710,115, entitled "Devices and Methods for Controlling Brightness of a Display Backlight", filed Oct. 5, 2012, which is herein incorporated by reference.

BACKGROUND

The present disclosure relates generally to electronic displays and, more particularly, to controlling brightness of a display backlight.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery-powered devices or in other contexts where it is desirable to minimize power usage.

LCDs typically include an LCD panel having, among other things, a liquid crystal layer and various circuitry for controlling orientation of liquid crystals within the layer to modulate an amount of light passing through the LCD panel and thereby render images on the panel. A display driver for the LCD produces images on the display by adjusting an image signal supplied to each pixel across the display. The brightness of an LCD depends on the amount of light provided by a backlight assembly. As the backlight assembly provides more light, the brightness of the LCD increases. Backlight drivers may supply driving current to the backlight assembly to illuminate the LCD at a desired brightness level. The driving current may have a constant peak value and may be modulated with a variable duty cycle, such as by using a pulse width modulated signal. Varying the duty cycle may adjust the brightness level of the backlight assembly. Unfortunately, controlling the duty cycle of the pulse width modulation signals with good linearity may be complex and may be implemented inefficiently in the LCD.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to various techniques, systems, devices, and methods for controlling brightness of a display backlight. Light-emitting diode (LED) strings of the display backlight may be powered by current signals provided by a backlight driver chip. By varying the current signals provided to the LED strings, the brightness of the display backlight may be adjusted. The current signals may be varied by changing a duty cycle of a pulse width modulation (PWM) signal that drives the current signals. In one example, a backlight driver chip receives an input duty cycle. The backlight driver chip may determine a reduced duty cycle by determining a product of the input duty cycle and a maximum duty cycle. Furthermore, the backlight driver chip may determine a correction factor based on the reduced duty cycle. Moreover, the backlight driver may determine a corrected duty cycle by determining a product of the reduced duty cycle and the correction factor. The backlight driver chip may determine an output duty cycle by comparing a minimum duty cycle and the corrected duty cycle to limit the controlled duty cycle to a minimum value. In addition, the backlight driver chip may provide a current output based on the output duty cycle.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 10 illustrates a lookup table having zones and corresponding correction factors, in accordance with an embodiment;

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
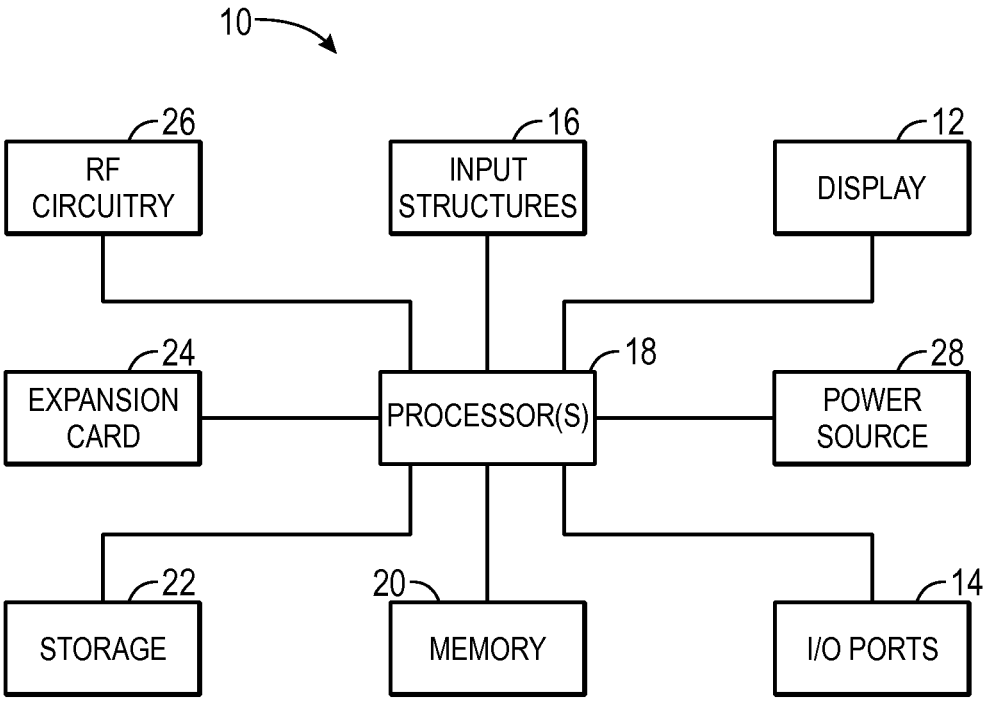
FIG. 1 illustrates a block diagram of an electronic device that may use the techniques disclosed herein, in accordance with aspects of the present disclosure.

With the foregoing in mind, it is useful to begin with a general description of suitable electronic devices that may employ the display devices and techniques described below. In particular, FIG. 1 is a block diagram depicting various components that may be present in an electronic device suitable for use with such display devices and techniques. FIGS. 2, 3, 4, and 5 illustrate front and perspective views of suitable electronic devices, which may be, as illustrated, a handheld electronic device, a tablet computing device, a notebook computer, or a desktop computer.

Turning first to FIG. 1, an electronic device 10 according to an embodiment of the present disclosure may include, among other things, a display 12, input/output (I/O) ports 14, input structures 16, one or more processor(s) 18, memory 20, nonvolatile storage 22, an expansion card 24, RF circuitry 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

Figure 2:
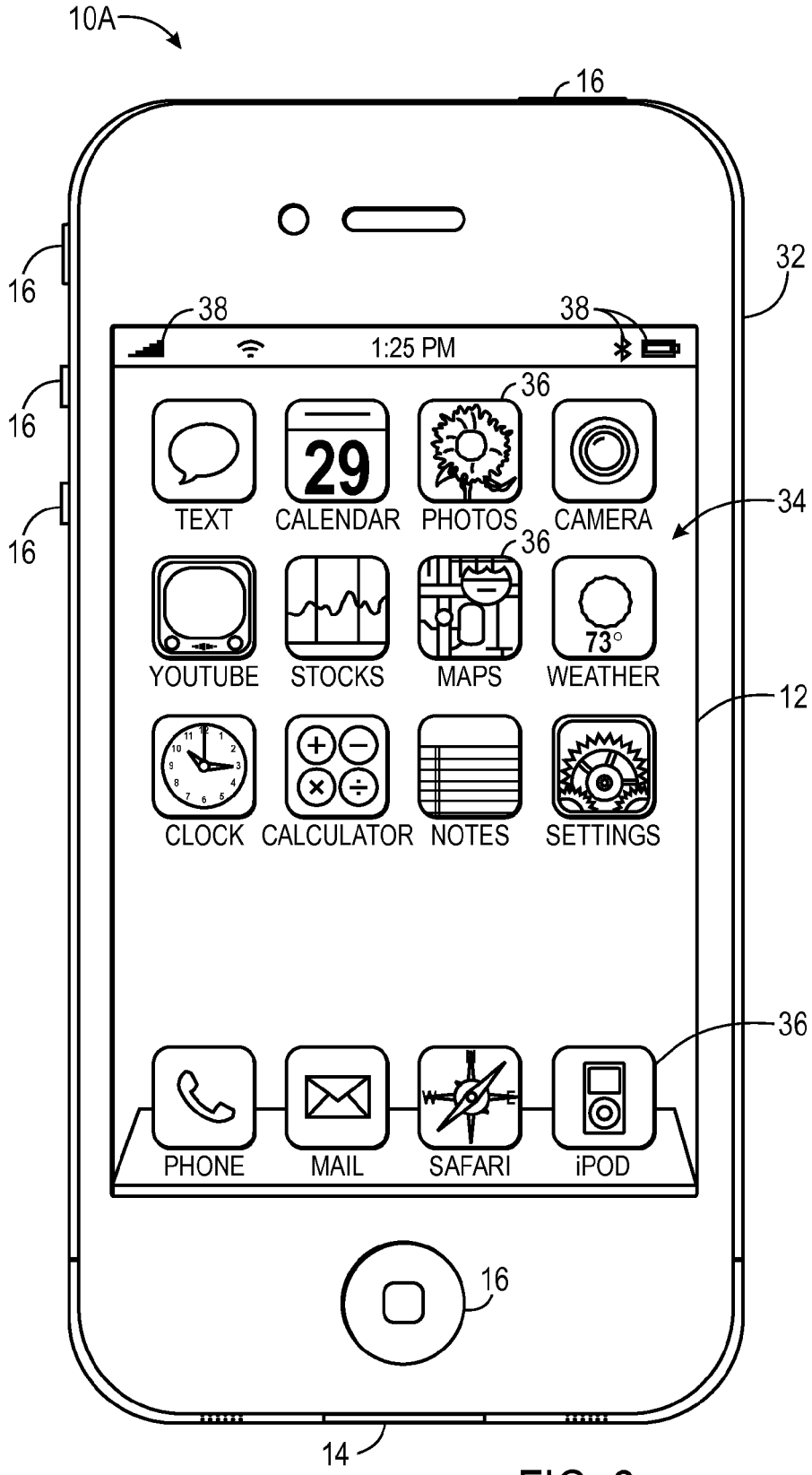
FIG. 2 illustrates a front view of a handheld device, such as an iPhone, representing another embodiment of the electronic device of FIG. 1, in accordance with an embodiment.
Figure 3:
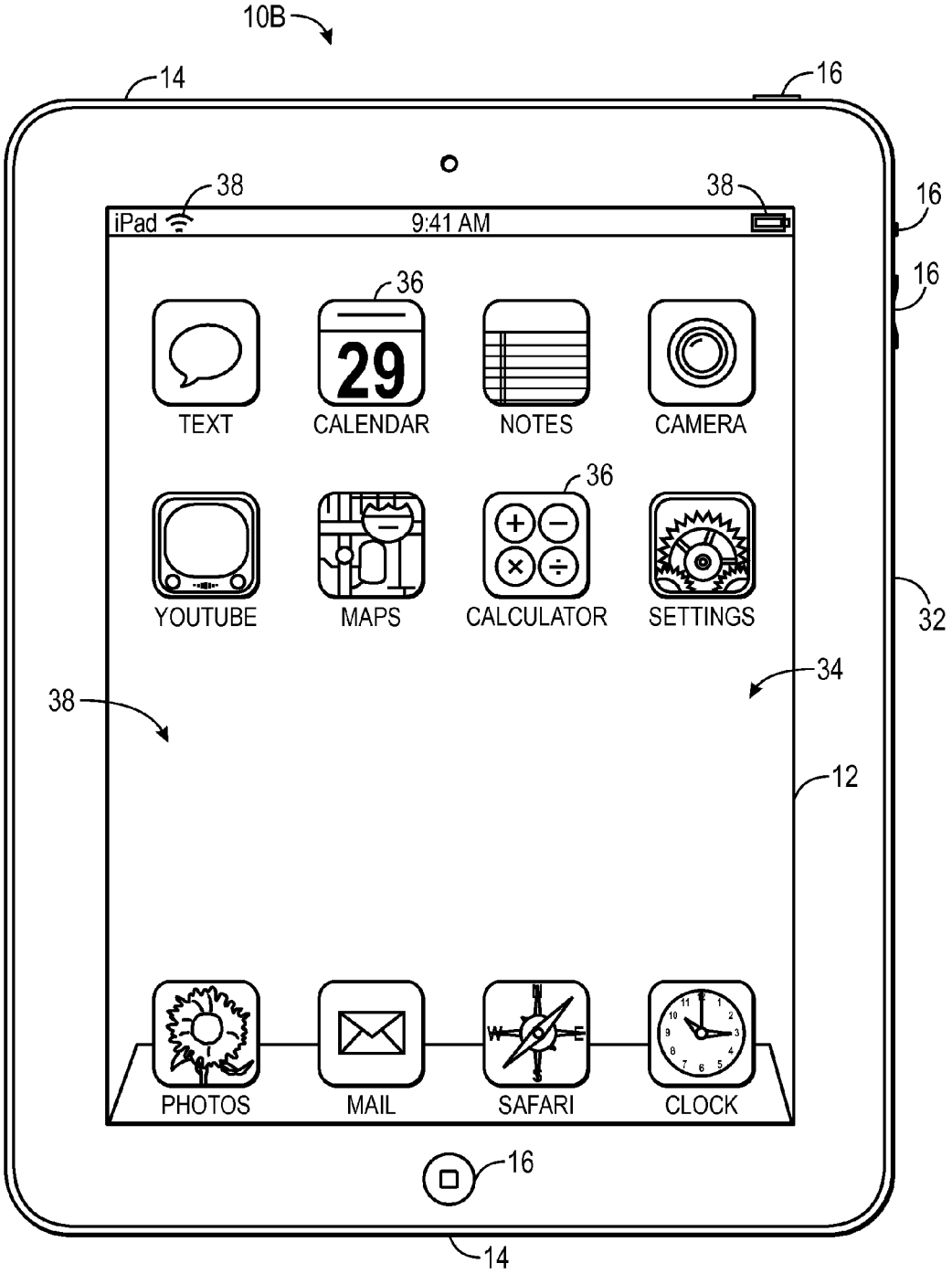
FIG. 3 illustrates a front view of a tablet device, such as an iPad, representing a further embodiment of the electronic device of FIG. 1, in accordance with an embodiment.
Figure 4:
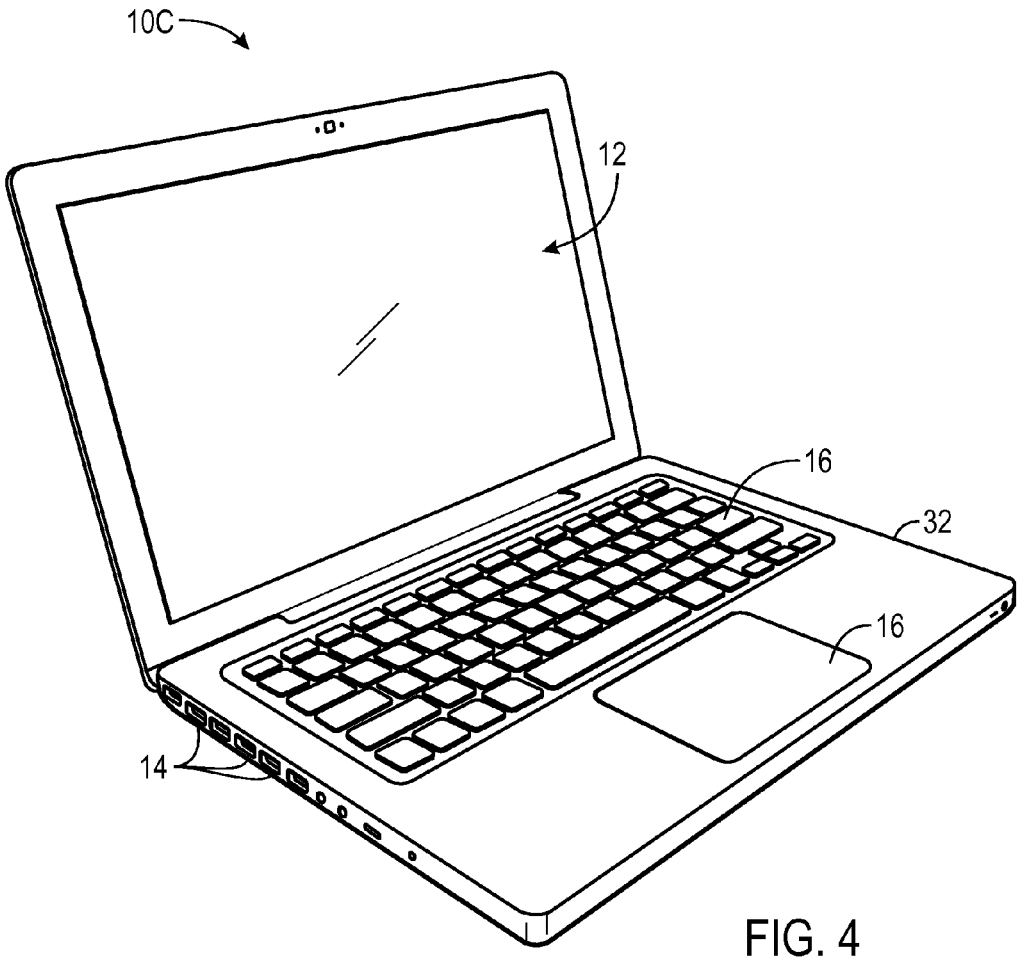
FIG. 4 illustrates a front view of a laptop computer, such as a MacBook, representing an embodiment of the electronic device of FIG. 1, in accordance with an embodiment.
Figure 5:
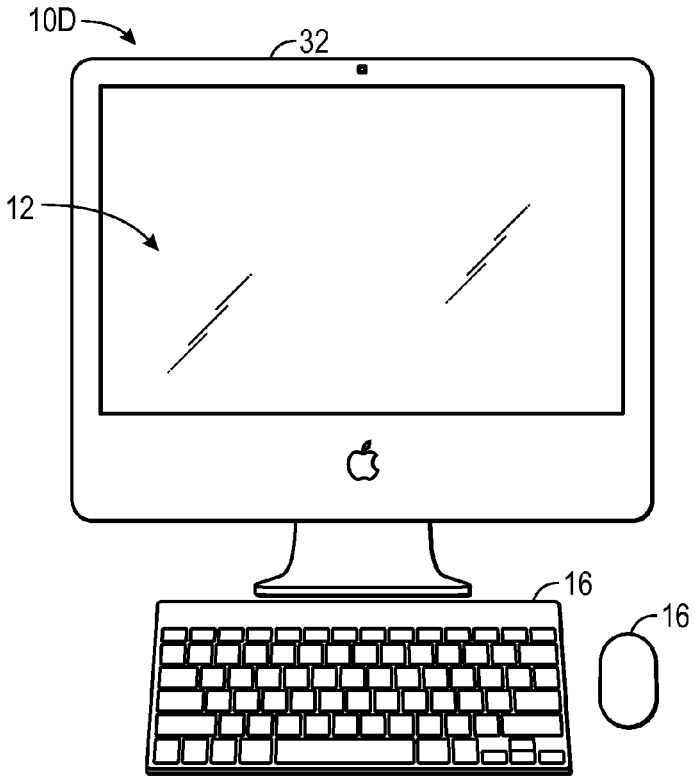
FIG. 5 illustrates a front view of a desktop computer, such as an iMac, representing another embodiment of the electronic device of FIG. 1, in accordance with an embodiment.

By way of example, the electronic device 10 may represent a block diagram of the handheld device depicted in FIG. 2, the tablet computing device depicted in FIG. 3, the notebook computer depicted in FIG. 4, the desktop computer depicted in FIG. 5, or similar devices, such as televisions, and so forth. It should be noted that the processor(s) 18 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 18 and/or other data processing circuitry may be operably coupled with the memory 20 and the nonvolatile storage 22 to execute instructions. Such programs or instructions executed by the processor(s) 18 may be stored in any suitable article of manufacture that includes one or more tangible, computer-readable media at least collectively storing the instructions or routines, such as the memory 20 and the nonvolatile storage 22. The memory 20 and the nonvolatile storage 22 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 18.

The display 12 may be a touch-screen liquid crystal display (LCD), for example, which may enable users to interact with a user interface of the electronic device 10. In some embodiments, the electronic display 12 may be a MultiTouch™ display that can detect multiple touches at once.

The input structures 16 of the electronic device 10 may enable a user to interact with the electronic device 10 (e.g., pressing a button to increase or decrease a volume level). The I/O ports 14 may enable electronic device 10 to interface with various other electronic devices, as may the expansion card 24 and/or the RF circuitry 26. The expansion card 24 and/or the RF circuitry 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

As mentioned above, the electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). FIG. 2 depicts a front view of a handheld device 10A, which represents one embodiment of the electronic device 10. The handheld device 10A may represent, for example, a portable phone, a media player, a personal data organizer, a handheld game platform, or any combination of such devices. By way of example, the handheld device 10A may be a model of an iPod® or iPhone® available from Apple Inc. of Cupertino, Calif.

The handheld device 10A may include an enclosure 32 to protect interior components from physical damage and to shield them from electromagnetic interference. The enclosure 32 may surround the display 12, which may include a screen 34 for displaying icons 36. The screen 34 may also display indicator icons 38 to indicate, among other things, a cellular signal strength, Bluetooth connection, and/or battery life. The I/O ports 14 may open through the enclosure 32 and may include, for example, a proprietary I/O port from Apple Inc. to connect to external devices.

User input structures 16, in combination with the display 12, may allow a user to control the handheld device 10A. For example, the input structures 16 may activate or deactivate the handheld device 10A, navigate a user interface to a home screen, navigate a user interface to a user-configurable application screen, activate a voice-recognition feature of the handheld device 10A, provide volume control, and toggle between vibrate and ring modes. The electronic device 10 may also be a tablet device 10B, as illustrated in FIG. 3. For example, the tablet device 10B may be a model of an iPad® available from Apple Inc.

In certain embodiments, the electronic device 10 may take the form of a computer, such as a model of a MacBook®, MacBook® Pro, MacBook Air®, iMac®, Mac® mini, or Mac Pro® available from Apple Inc. By way of example, the electronic device 10, taking the form of a notebook computer 10C, is illustrated in FIG. 4 in accordance with one embodiment of the present disclosure. The depicted computer 10C may include a housing 32, a display 12, I/O ports 14, and input structures 16. In one embodiment, the input structures 16 (such as a keyboard and/or touchpad) may be used to interact with the computer 10C, such as to start, control, or operate a GUI or applications running on computer 10C. For example, a keyboard and/or touchpad may allow a user to navigate a user interface or application interface displayed on the display 12. The electronic device 10 may also take the form of a desktop computer 10D, as illustrated in FIG. 5. The desktop computer 10D may include a housing 32, a display 12, and input structures 16.

Figure 6:
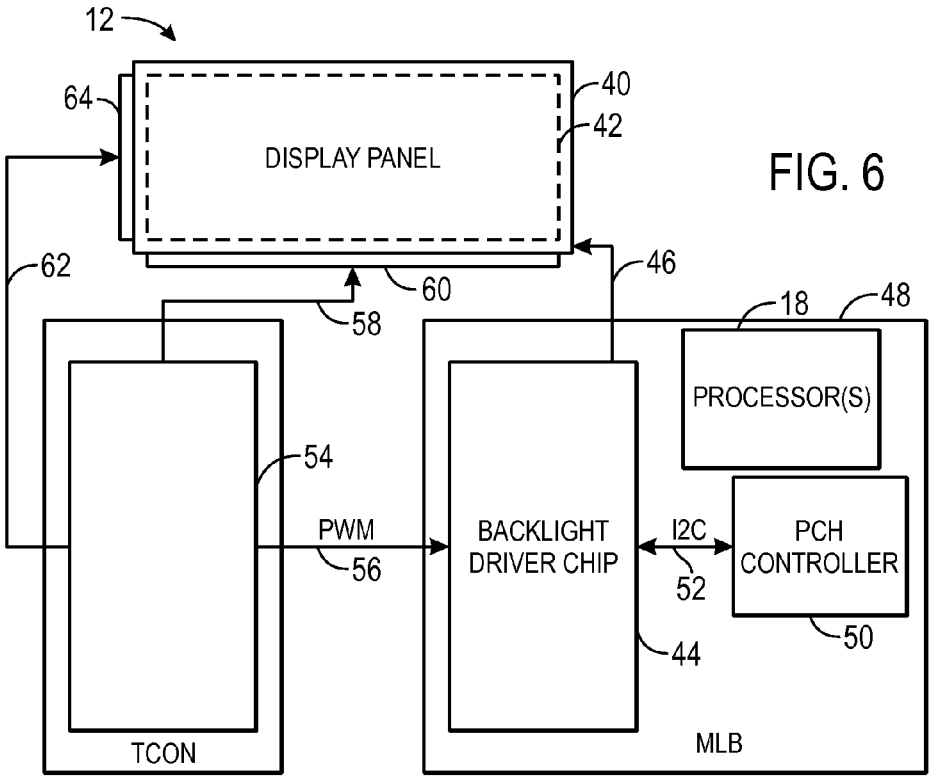
FIG. 6 illustrates a block diagram representing the display of FIG. 1 having a backlight and a backlight driver chip for driving the backlight, in accordance with an embodiment.

An electronic device 10, such as the devices 10A, 10B, 10C, and 10D discussed above, may include a backlight for illuminating the display 12. FIG. 6 illustrates a block diagram of the display 12 having a backlight and a backlight driver chip for driving the backlight. The display 12 includes a display panel 40, such as a liquid crystal display (LCD) panel. The display panel 40 includes a backlight 42 for illuminating the panel 40. A backlight driver chip 44 provides power to the backlight 42 via a driving output 46. The backlight driver chip 44 may control the output power of the driving output 46 to control the brightness of the backlight 42. Accordingly, the backlight driver chip 44 may control the brightness of the backlight 42.

The backlight driver chip 44 may be disposed on a main logic board 48, as illustrated. Furthermore, the main logic board 48 may include one or more processors 18 and a platform controller hub (PCH) controller 50. The PCH 50 is configured to exchange data with the backlight driver chip 44 via an inter-integrated circuit ($I^2C$) interface 52. For example, the PCH controller 50 may provide a duty cycle to the backlight driver chip 44. The backlight driver chip 44 may also receive data from a timing controller (TCON) 54 via a pulse width modulation (PWM) input 56. For example, the TCON 54 may provide a duty cycle to the backlight driver chip 44 via the PWM input 56.

The TCON 54 may transmit timing and column image data along a column data line 58 to one or more column drivers 60, and timing and row image data along a row data line 62 to one or more row drivers 64. These column drivers 60 and row drivers 64 may generate image signals for driving the various pixels of the display panel 40 based on the image data.

The backlight driver chip 44 may be configured to receive the input duty cycle from the PCH controller 50 and/or the TCON 54 and to modify the input duty cycle based on one or more of a correction factor, a minimum duty cycle, and a maximum duty cycle. In certain embodiments, the backlight driver chip 44 may include circuitry configured to modify the input duty cycle without receiving externally supplied inputs (other than the input duty cycle).

For example, the backlight driver chip 44 may determine a correction factor using the input duty cycle and other control circuitry that are physically part of the backlight driver chip 44. Accordingly, the backlight driver chip 44 does not use external software and/or hardware (e.g., external to the backlight driver chip 44, not part of the backlight driver chip 44, etc.) to determine the correction factor. Instead, the correction factor is determined solely by the backlight driver chip 44 and is based on the input duty cycle being the only externally supplied input for determining the correction factor. Because software external to the backlight driver chip 44 and processors 18 external to the backlight driver chip 44 are not used to determine the correction factor, the correction factor may be determined faster, with fewer components, and with significantly less effort than in displays 12 in which the backlight driver chip 44 relies on external hardware and/or software for determining the correction factor.

The backlight driver chip 44 may also be configured to drive a current of the driving output 46 for powering the backlight 42 based on a PWM signal produced using the modified input duty cycle. The brightness of the backlight 42 may depend on the peak output current and its duty cycle. Accordingly, the backlight driver chip 44 may control the brightness of the backlight 42.

Figure 7:
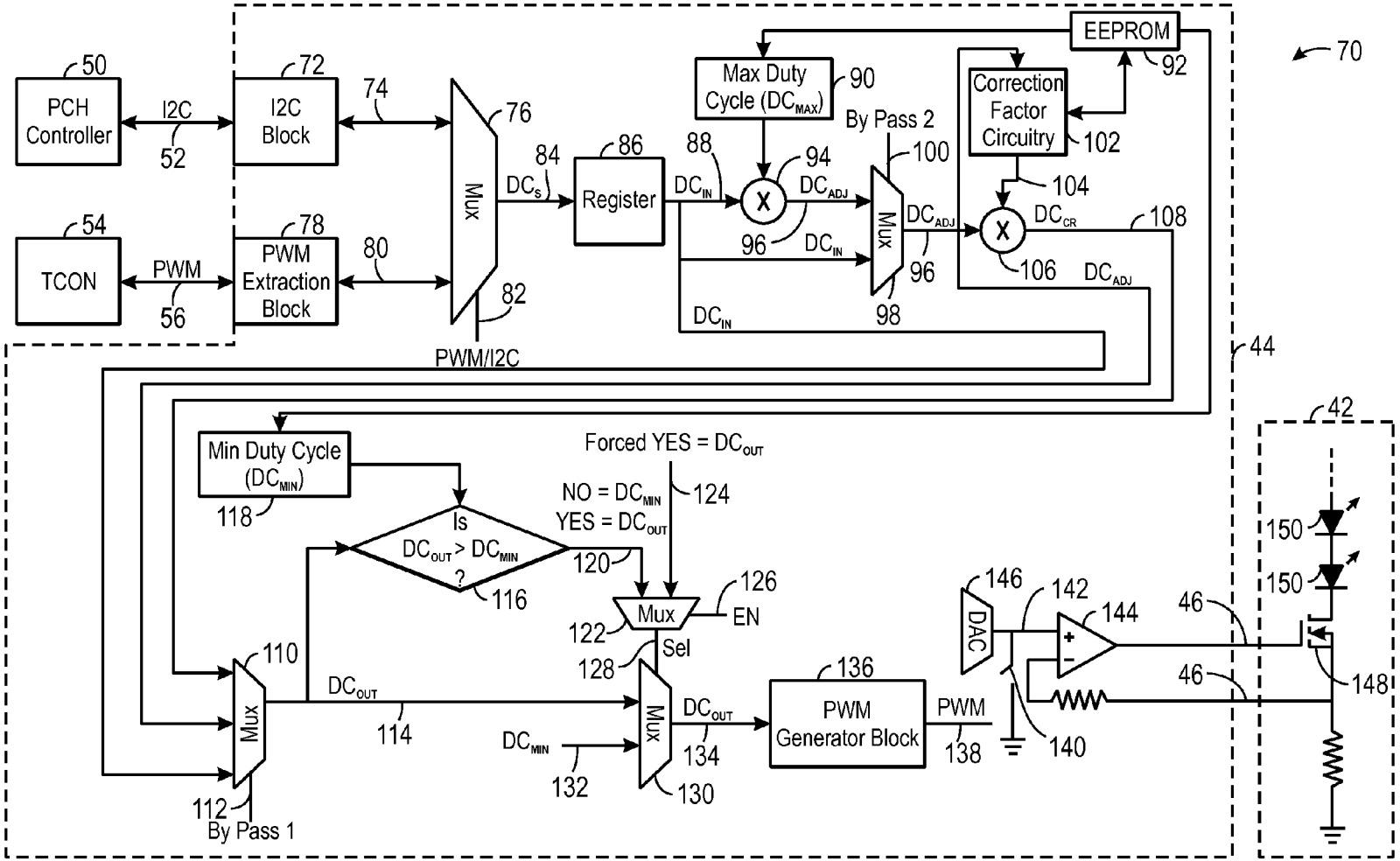
FIG. 7 illustrates a block diagram of the backlight driver chip of FIG. 6, in accordance with an embodiment.

The backlight driver chip 44 may be configured to determine a brightness correction factor in various ways. FIG. 7 illustrates a block diagram of a system 70 having one embodiment of the backlight driver chip 44 of FIG. 6. As discussed above, the PCH controller 50 may provide data, including an input duty cycle, to the backlight driver chip 44 via the $I^2C$ interface 52. Furthermore, the TCON 54 may provide data, including an input duty cycle, to the backlight driver chip 44 via the PWM input 56. The backlight driver chip 44 may include an $I^2C$ block 72 configured to receive the data from the PCH controller 50, to identify an input duty cycle within the data, and to provide the input duty cycle serially to an input 74 of a multiplexer 76. Moreover, the backlight driver chip 44 may include a PWM extraction block 78 configured to receive the data from the TCON 54, to identify an input duty cycle within the data, and to provide the input duty cycle serially to an input 80 of the multiplexer 76.

The multiplexer 76 includes a selection input 82 configured to select one of the inputs 74 and 80 and to provide to a serial duty cycle ($DC_S$) 84 for use within the backlight driver chip 44. As may be appreciated, the selection input 82 may be configured based on desired operation of the backlight driver chip 44. In certain embodiments, the selection input 82 may be statically configured to not change its selection after being configured (e.g., unless reconfigured), while in other embodiments, the selection input 82 may be dynamically configured to facilitate change during operation of the backlight driver chip 44.

A register 86 (e.g., brightness register) receives the $DC_S$ 84 data serially and stores the $DC_S$ 84 data until the register 86 has received a complete representation of a duty cycle (e.g., 8 bits, 16 bits, 32 bits, etc.). After the register 86 receives a complete representation of a duty cycle, the register 86 provides an input duty cycle ($DC_{IN}$) 88 to other components, such as via a 16-bit parallel data bus. In certain embodiments, it may be desirable to not use a full range of duty cycles from 0 to 100% for producing the PWM output. The duty cycle range may be limited so that the maximum brightness provided by the backlight 42 matches system requirements. Accordingly, the backlight driver chip 44 may adjust the $DC_{IN}$ 88 based on a predetermined maximum duty cycle ($DC_{MAX}$) 90. The backlight driver chip 44 includes a storage device, such as an electronically erasable programmable read only memory (EEPROM) 92, to store the $DC_{MAX}$ 90.

The $DC_{IN}$ 88 and the $DC_{MAX}$ 90 are provided to a multiplier 94 configured to output an adjusted duty cycle ($DC_{ADJ}$) 96. The $DC_{ADJ}$ 96 is determined by computing a product of the $DC_{IN}$ 88 and the $DC_{MAX}$ 90, thus limiting the duty cycle and scaling the input duty cycle based on the predetermined maximum duty cycle. For example, if the $DC_{IN}$ 88 were 100% and the $DC_{MAX}$ 90 were 70%, then the $DC_{ADJ}$ 96 would be 70% (e.g., the input duty cycle is limited by the maximum duty cycle). As another example, if the $DC_{IN}$ 88 were 70% and the $DC_{MAX}$ 90 were 60%, then the $DC_{ADJ}$ 96 would be 42% (e.g., the input duty cycle is scaled in relation to the maximum duty cycle).

The $DC_{IN}$ 88 and the $DC_{ADJ}$ 96 are both provided to a multiplexer 98. Based on a selection input 100, the multiplexer 98 may be configured to output either the $DC_{IN}$ 88 or the $DC_{ADJ}$ 96. If the $DC_{IN}$ 88 is selected by the selection input 100, the maximum duty cycle limitation is bypassed. As may be appreciated, the selection input 100 may be used to select the $DC_{IN}$ 88 during testing and/or configuration of the backlight driver chip 44. During general operation of the backlight driver chip 44, the selection input 100 may be configured to output the $DC_{ADJ}$ 96, as illustrated.

After being output from the multiplexer 98, the $DC_{ADJ}$ 96 is provided to correction factor circuitry 102. The correction factor circuitry 102 uses the $DC_{ADJ}$ 96 to determine a correction factor 104 for brightness tuning of the backlight 42. For example, the correction factor circuitry 102 may use the $DC_{ADJ}$ 96 to determine a duty cycle zone. Moreover, the correction factor circuitry 102 may use the duty cycle zone to access the correction factor 104 from a lookup table in the EEPROM 92. As another example, the correction factor circuitry 102 may use the $DC_{ADJ}$ 96 to determine a range that the $DC_{ADJ}$ 96 falls within (e.g., a zone). The correction factor circuitry 102 may use the range to access multiple correction factors that correspond to the range from a lookup table in the EEPROM 92. Furthermore, the correction factor circuitry 102 may interpolate the correction factor 104 using the range and the multiple correction factors.

The correction factor 104 and the $DC_{ADJ}$ 96 are provided to a multiplier 106 configured to output a corrected duty cycle ($DC_{CR}$) 108. The $DC_{CR}$ 108 is determined by computing a product of the $DC_{ADJ}$ 96 and the correction factor 104, thus facilitating brightness tuning of the backlight 42.

The $DC_{IN}$ 88, the $DC_{ADJ}$ 96, and the $DC_{CR}$ 108 are all provided to a multiplexer 110. Based on a selection input 112, the multiplexer 110 may be configured to output the $DC_{IN}$ 88, the $DC_{ADJ}$ 96, or the $DC_{CR}$ 108. If the $DC_{IN}$ 88 is selected by the selection input 112, the maximum duty cycle limitation is bypassed. Moreover, if the $DC_{ADJ}$ 96 is selected by the selection input 112, the brightness correction factor adjustment is bypassed. As may be appreciated, the selection input 112 may be used to select the $DC_{IN}$ 88 or the $DC_{ADJ}$ 96 during testing and/or configuration of the backlight driver chip 44. During general operation of the backlight driver chip 44, the selection input 112 may be configured to output the $DC_{CR}$ 108 as a duty cycle output ($DC_{OUT}$) 114, as illustrated.

At block 116, the $DC_{OUT}$ 114 is compared to a predetermined minimum duty cycle ($DC_{MIN}$) 118 to determine whether the $DC_{OUT}$ 114 is greater than the $DC_{MIN}$ 118. As may be appreciated, the $DC_{MIN}$ 118 may be stored on the EEPROM 92. Before being stored on the EEPROM 92, the $DC_{MIN}$ 118 may be determined using a number of factors, such as a response time of a light-emitting diode (LED) of the backlight 42, a gain bandwidth (GBW) of a current sink, and a boost transient response.

The minimum PWM pulse may be limited by the LED response time, which typically ranges from 50 to 100 ns. However, in certain embodiments, the LED may be a phosphor-converted white LED. A phosphor-converted white LED may have a slower response time than a pump LED (e.g., blue LED), such as having a response time of 30 to 300 ns. Thus, the response time of a phosphor-converted white LED (e.g., decay) may be a significant factor when using a high PWM clock frequency (e.g., greater than 20 KHz). Accordingly, the minimum PWM pulse may be defined based on the response time of a phosphor-converted white LED. In one example, the response time of an LED may be a sum of a rise time (e.g., 100 ns), a fall time (e.g., 100 ns), and an additional phosphor decay time (e.g., 100 ns). Accordingly, the response time may be approximately 300 ns.

Returning to block 116, if the $DC_{OUT}$ 114 is greater than the $DC_{MIN}$ 118, a signal 120 may indicate a first output (e.g., "YES", logic high). On the other hand, if the $DC_{OUT}$ 114 is less than or equal to the $DC_{MIN}$ 118, the signal 120 may indicate a second output (e.g., "NO", logic low). The signal 120 is provided to a multiplexer 122. A signal 124 is also provided to the multiplexer 122. The signal 124 may be used to force the $DC_{OUT}$ 114 to be used, even if the $DC_{OUT}$ 114 is less than the $DC_{MIN}$ 118. A selection input 126 determines which input is selected from the multiplexer 122. The output from the multiplexer 122 is provided to a selection input 128. The selection input 128 is used to select one of the inputs provided to a multiplexer 130. The selection input 128 may select either the $DC_{OUT}$ 114 or a $DC_{MIN}$ 132.

The multiplexer 130 provides an output duty cycle ($DC_{OUT}$) 134 to a PWM generation block 136. The PWM generation block 136 controls a PWM output 138. Moreover, the PWM output 138 determines whether a switch 140 is open or closed. The position of the switch 140 will determine an input 142 to an amplifier 144 (e.g., op-amp). If the switch 140 is open, a digital-to-analog converter (DAC) 146 provides a signal to the input 142. However, if the switch 140 is closed, the input 142 is pulled to ground. The current of the driving output 46 from the amplifier 144 is configured to control the operation of a switching device 148 (e.g., MOSFET), and thereby control a lighting device 150 (e.g., LEDs, one or more LED strings) of the backlight 42.

As may be appreciated, the PWM generation block 136 (or another device) may be configured to implement minimum duty cycle sloping. For example, if a duty cycle is commanded to go below a minimum duty cycle, the PWM generation block 136 may control the duty cycle so that the duty cycle slopes down to 0% brightness. Conversely, if a duty cycle above a minimum duty cycle is commanded from a starting point of 0% brightness, the PWM generation block 136 may control the duty cycle to slope upward from 0% brightness. As another example, if a duty cycle is commanded to go below a minimum duty cycle, the PWM generation block 136 may be configured to control the duty cycle so that the duty cycle slopes down only to the minimum duty cycle. Likewise, if the duty cycle is commanded to go from below a minimum duty cycle, the PWM generation block 136 may be configured to control the duty cycle so that the duty cycle slopes up from only the minimum duty cycle.

Figure 8:
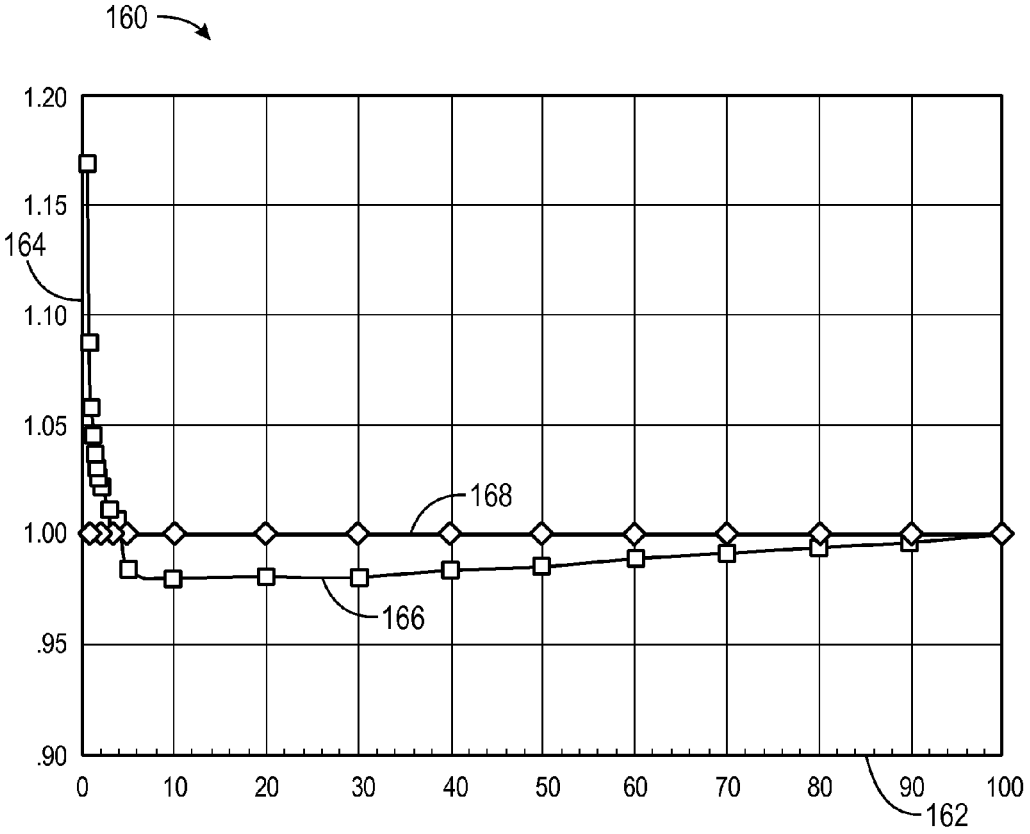
FIG. 8 illustrates a graph of a relationship between a pulse width modulation (PWM) duty cycle and a correction factor, in accordance with an embodiment.

The brightness correction factor applied to the duty cycle may be based on a relationship between a PWM duty cycle and a correction factor, as illustrated by a graph 160 in FIG. 8. There are various factors that can affect the brightness linearity, such as variations in peak LED current at different brightness levels, LED response time (e.g., turn ON/OFF) at reduced brightness, boost converter transient response at reduced brightness, open loop at reduced brightness, and variations in LED luminosity with temperature (e.g., temperature goes high with a higher duty cycle). In FIG. 8, an x-axis 162 represents a PWM duty cycle, while a y-axis 164 represents a linearity factor. A curve 166 illustrates that when the PWM duty cycle is low, the linearity factor is high. The linearity factor then changes such that when the PWM duty cycle is high, the linearity factor approaches one. A curve 168 illustrates that when a correction factor is applied to the PWM duty cycle, the linearity factor remains at approximately one.

Figure 9:
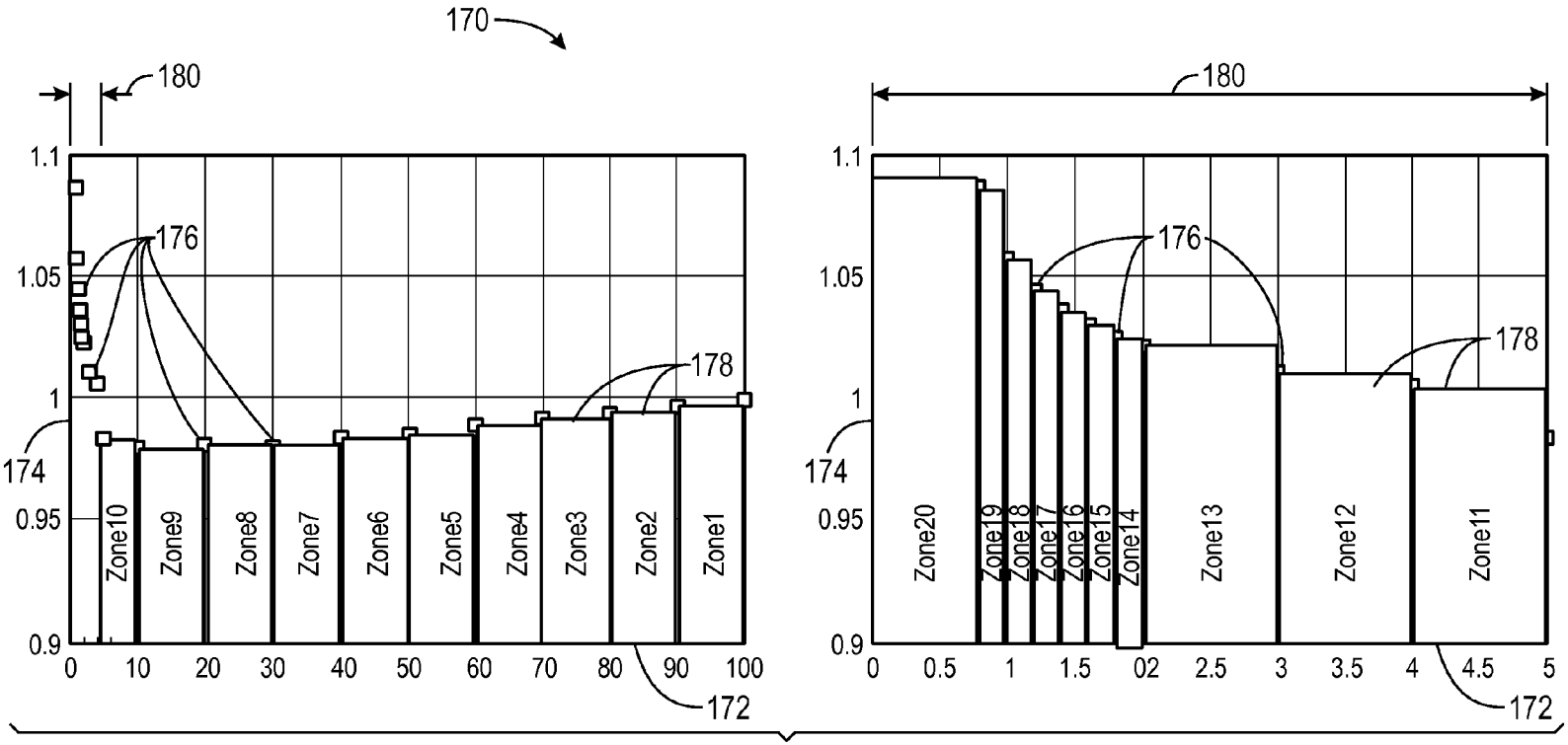
FIG. 9 illustrates a graph of PWM duty cycles divided into brightness zones, in accordance with an embodiment.

The linearity factors may be segmented into multiple PWM duty cycle brightness zones. FIG. 9 illustrates a graph 170 of PWM duty cycles divided into brightness zones. An x-axis 172 represents a PWM duty cycle, while a y-axis 174 represents a linearity factor. Data points 176 indicate specific linearity factors. The PWM duty cycles are divided into ranges or zones 178. In the illustrated embodiment there are 20 zones 178; however, in other embodiments there may be any suitable number of zones 178. Each zone 178 may have a corresponding linearity factor, as illustrated by data points 176 adjacent to each respective zone 178. The illustrated zones 11 through 20 represent a duty cycle subset 180 than includes duty cycles in the range of 0 to 5%. The zones 178, the PWM duty cycle ranges, and the correction factors may be organized into a lookup table. For example, FIG. 10 illustrates a lookup table 190 having zones and corresponding correction factors. Specifically, the lookup table 190 includes a zone column 192, a duty cycle range column 194, and a correction factor column 196. As may be appreciated, if a specific zone from the zone column 192 were selected, a correction factor from the correction factor column 196 that corresponds to the zone may be identified. Furthermore, if a specific duty cycle range from the duty cycle range column 194 were selected, a correction factor from the correction factor column 196 that corresponds to the duty cycle range may be identified.

Figure 11:
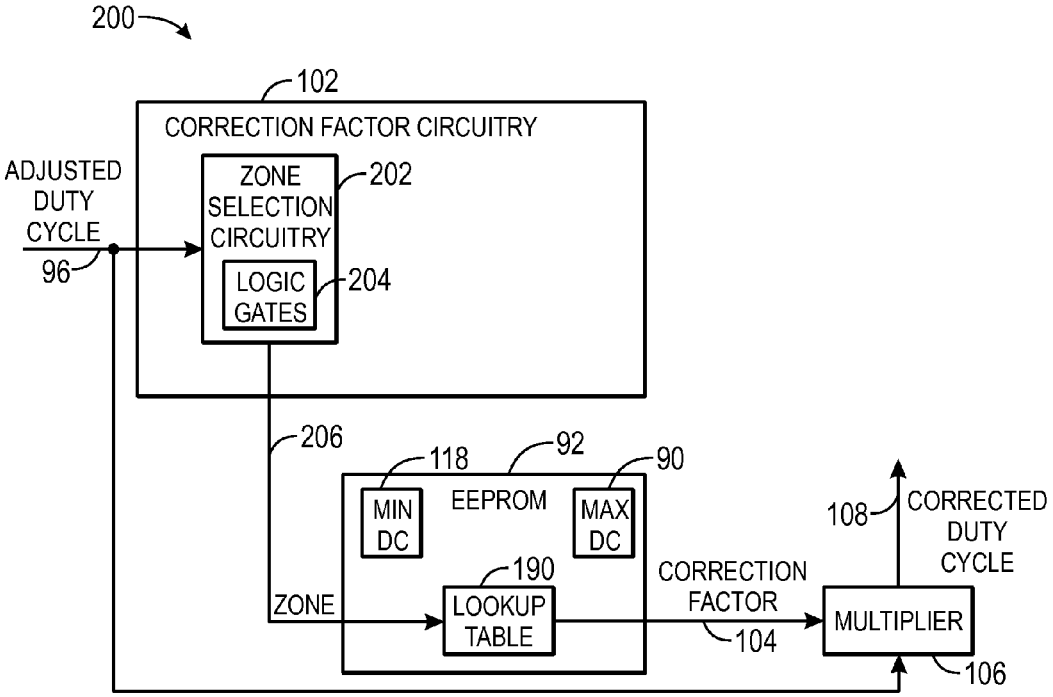
FIG. 11 illustrates a block diagram of correction circuitry using a zoning technique, in accordance with an embodiment.
Figure 12:
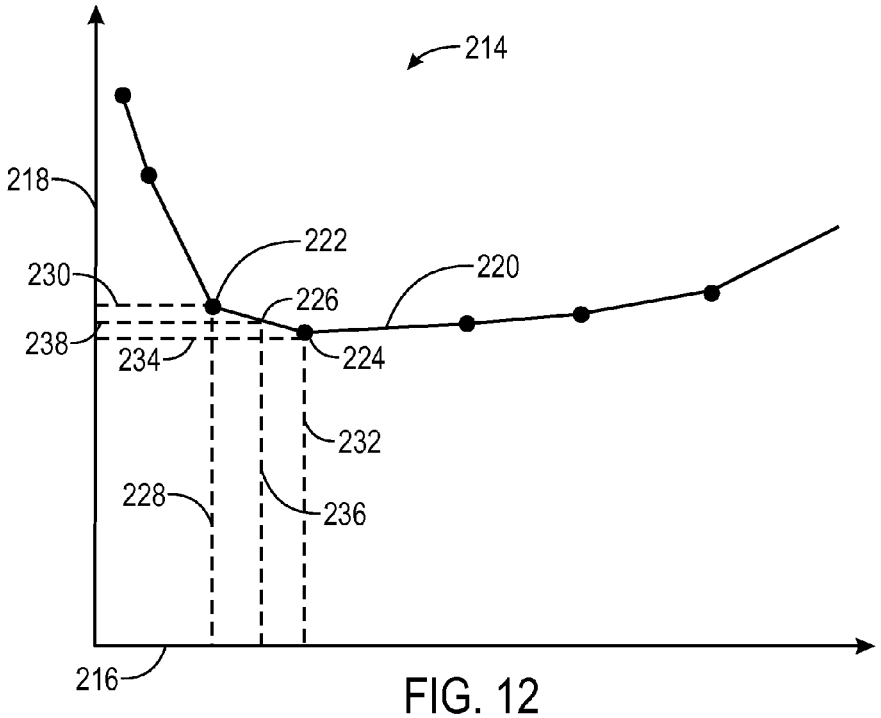
FIG. 12 illustrates a graph representing a linear interpolation technique, in accordance with an embodiment.
Figure 13:
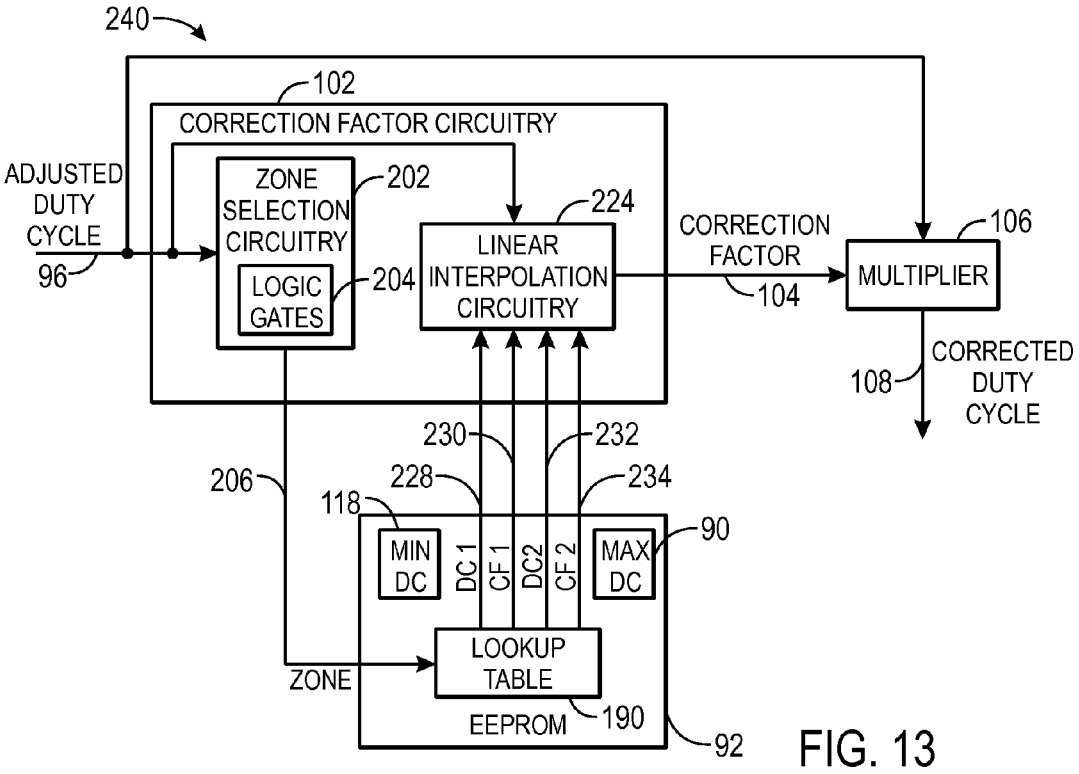
FIG. 13 illustrates a block diagram of correction circuitry using a linear interpolation technique, in accordance with an embodiment.

There are multiple ways for the backlight driver chip 44 to determine a correction factor. For example, the backlight driver chip 44 may use a zoning method where a constant correction factor is used for any duty cycle that falls within a predetermined zone or range, as illustrated in FIG. 11. As another example, the backlight driver chip 44 may use linear interpolation to determine a correction factor, as illustrated in FIGS. 12-13. FIG. 11 illustrates a block diagram of correction circuitry 200 using the zoning technique. As illustrated, the $DC_{ADJ}$ 96 is provided to the correction factor circuitry 102. The correction factor circuitry 102 includes zone selection circuitry 202 configured to receive the $DC_{ADJ}$ 96 and to select a zone or range that corresponds to the duty cycle. For example, if the $DC_{ADJ}$ 96 were 76%, the zone selection circuitry 202 may select zone 3. The zone selection circuitry 202 may include various logic gates 204 to simplify the selection of a zone. For example, a combination of logic gates 204 may receive a 16-bit input of the $DC_{ADJ}$ 96. Based on significant bits of the 16-bit input, the logic gates 204 may select and/or output a zone that corresponds to the 16-bit input.

The zone selection circuitry 202 outputs a zone 206 to the lookup table 190 in the EEPROM 92. The EEPROM 92 then outputs the correction factor 104 that corresponds to the zone 206. The correction factor 104 and the $DC_{ADJ}$ 96 are provided to the multiplier 106 which is configured to output the corrected duty cycle $DC_{CR}$ 108. The $DC_{CR}$ 108 is determined by computing the product of the $DC_{ADJ}$ 96 and the correction factor 104, thus facilitating brightness tuning of the backlight 42. As illustrated, the EEPROM 92 includes the $DC_{MAX}$ 90 and the $DC_{MIN}$ 118.

The backlight driver chip 44 may use linear interpolation to determine the correction factor. FIG. 12 illustrates a graph 214 representing a linear interpolation technique. An x-axis 216 represents a PWM duty cycle, while a y-axis 218 represents a linearity factor. A curve 220 represents a relationship between the PWM duty cycle and the linearity factor. A point 222 and a point 224 represent two adjacent (e.g., neighboring) data points on the curve 220. Using linear interpolation a point 226 between the points 222 and 224 may be determined if the duty cycle is known. The point 222 has a duty cycle $DC_{ADJ(n-1)}$ 228 and a linearity factor $CF_{(n-1)}$ 230. The point 224 has a duty cycle $DC_{ADJ(n)}$ 232 and a linearity factor $CF_{(n)}$ 234. Moreover, the point 226 has a duty cycle $DC_{ADJ(x)}$ 236 and a linearity factor $CF_{(x)}$ 238. Accordingly, the $CF_{(x)}$ 238 may be calculated using linear interpolation using the following formula: $CF_{(x)}$ 238=$CF_{(n-1)}$ 230+[$CF_{(n)}$ 234−$CF_{(n-1)}$ 230]*[$DC_{ADJ(x)}$ 236−$DC_{ADJ}$−$DC_{ADJ(n-1)}$ 228]/[$DC_{ADJ(n)}$ 232−$DC_{ADJ(n-1)}$ 228].

As may be appreciated, in certain embodiments the linear interpolation technique may provide a more accurate correction factor than using the zoning method. FIG. 13 illustrates a block diagram of correction circuitry 240 that may be used to apply the linear interpolation technique. As illustrated, the $DC_{ADJ}$ 96 is provided to the correction factor circuitry 102. The correction factor circuitry 102 includes the zone selection circuitry 202 configured to receive the $DC_{ADJ}$ 96 and to select a zone or range that corresponds to the duty cycle. For example, if the $DC_{ADJ}$ 96 were 76%, the zone selection circuitry 202 may select zone 3 or a range of duty cycles, such as 70-80%. The zone selection circuitry 202 may include various logic gates 204 to simplify the selection of a zone or range.

The zone selection circuitry 202 outputs the zone 206 (or range) to the lookup table 190 in the EEPROM 92. The EEPROM 92 then outputs data that corresponds to the zone 206. As illustrated, the EEPROM 92 outputs the $DC_{ADJ(n-1)}$ 228, the $CF_{(n-1)}$ 230, the $DC_{ADJ(n)}$ 232, and the $CF_{(n)}$ 234. The $DC_{ADJ(n-1)}$ 228, the $CF_{(n-1)}$ 230, the $DC_{ADJ(n)}$ 232, the $CF_{(n)}$ 234, and the $DC_{ADJ}$ 96 are provided to linear interpolation circuitry 224 of the correction factor circuitry 102. The linear interpolation circuitry 224 determines (e.g., calculates) the correction factor 104. The correction factor 104 and the $DC_{ADJ}$ 96 are provided to the multiplier 106 configured to output the corrected duty cycle $DC_{CR}$ 108. The $DC_{CR}$ 108 is determined by computing the product of the $DC_{ADJ}$ 96 and the correction factor 104, thus facilitating brightness tuning of the backlight 42.

Figure 14:
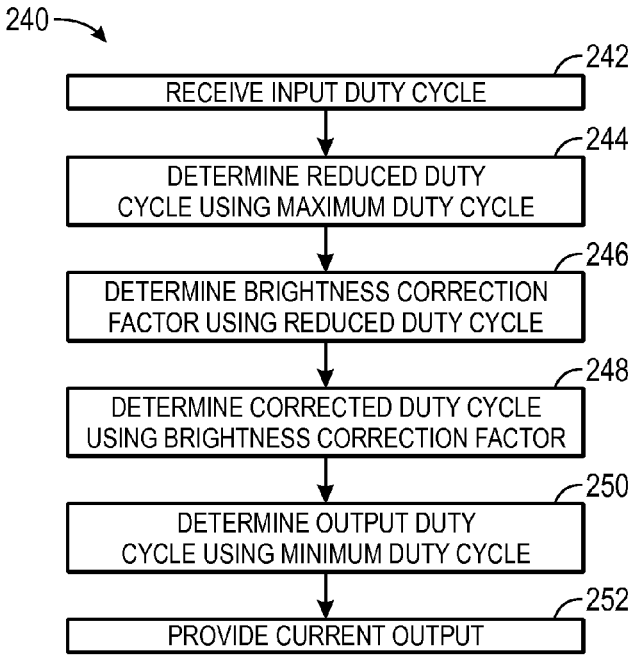
FIG. 14 illustrates a flow chart of a method for controlling brightness of a backlight of the display of FIG. 1, in accordance with an embodiment.

A method 240 for controlling brightness of the backlight 42 of the display 12 is illustrated in FIG. 14. The backlight driver chip 44 may receive an input duty cycle, such as $DC_S$ 84 or $DC_{IN}$ 88 (block 242). The backlight driver chip 44 may determine a reduced duty cycle (e.g., $DC_{ADJ}$ 96) (block 244). The reduced duty cycle may be a product of the input duty cycle and a maximum duty cycle (e.g., $DC_{MAX}$ 90). The backlight driver chip 44 may determine a brightness correction factor (e.g., correction factor 104) using the reduced duty cycle (block 246). The backlight driver chip 44 may determine a corrected duty cycle (e.g., $DC_{CR}$ 108) using the brightness correction factor (block 248). For example, the corrected duty cycle may be a product of the reduced duty cycle and the correction factor. The backlight driver chip 44 may determine an output duty cycle (e.g., $DC_{OUT}$ 134) using a minimum duty cycle (e.g., $DC_{MIN}$ 118) (block 250). The output duty cycle may be based on a comparison between the minimum duty cycle and the corrected duty cycle. For example, the output duty cycle may be the minimum duty cycle when the minimum duty cycle is greater than the corrected duty cycle. Furthermore, the output duty cycle may be the corrected duty cycle when the corrected duty cycle is greater than or equal to the minimum duty cycle. The backlight driver chip 44 may provide current outputs (e.g., driver output 46) based on the output duty cycle (block 252).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A backlight driver chip for an electronic display of an electronic device comprising:

an input configured to receive data corresponding to a duty cycle;

correction circuitry configured to determine a brightness correction factor based at least partially on the duty cycle and to determine a corrected duty cycle based at least partially on the brightness correction factor, wherein the correction circuitry comprises zone selection circuitry configured to receive the duty cycle, select a linearity factor zone based on the duty cycle, and determine the brightness correction factor based on the linearity factor zone; and an output configured to provide a current signal for driving a backlight device, wherein the current signal is based at least partially on the corrected duty cycle.

2. The backlight driver chip of claim 1, wherein the correction circuitry is configured to determine the brightness correction factor using a lookup table.

3. The backlight driver chip of claim 1, wherein the correction circuitry is configured to determine the brightness correction factor using linear interpolation of a plurality of brightness correction factors.

4. The backlight driver chip of claim 1, wherein determining the brightness correction factor using linear interpolation comprises performing linear interpolation using a first duty cycle and a corresponding first correction factor, and a second duty cycle and a corresponding second correction factor.

5. The backlight driver chip of claim 1, wherein the zone selection circuitry comprises a plurality of logic gates configured to select a zone based on the duty cycle.

6. The backlight driver chip of claim 1, comprising a storage device configured to store a plurality of brightness correction factors, wherein the plurality of brightness correction factors comprises the brightness correction factor.

7. The backlight driver chip of claim 1, wherein the current signal provided by the output is controlled by a pulse width modulated signal.

8. The backlight driver chip of claim 1, wherein the correction circuitry comprises a multiplier configured to determine the corrected duty cycle by multiplying the brightness correction factor by the duty cycle.

9. The backlight driver chip of claim 1, comprising a multiplier configured to multiply a maximum duty cycle by the duty cycle and to provide an adjusted duty cycle.

10. A method for driving a backlight of an electronic display comprising:

receiving an input duty cycle at an input of a backlight driver chip;

determining a brightness correction factor using the backlight driver chip and based at least partially on the input duty cycle;

determining a corrected duty cycle using the backlight driver chip and based at least partially on the brightness correction factor;

comparing the corrected duty cycle to a minimum duty cycle, wherein a current signal for driving a backlight device is based on the minimum duty cycle if the minimum duty cycle is greater than or equal to the corrected duty cycle; and providing the current signal for driving the backlight device at an output of the backlight driver chip, wherein the current signal is based at least partially on the corrected duty cycle.

11. The method of claim 10, comprising determining an adjusted duty cycle using a multiplier of the backlight driver chip to multiply the input duty cycle by a maximum duty cycle.

12. The method of claim 10, wherein determining the brightness correction factor comprises using linear interpolation of a plurality of brightness correction factors.

13. The method of claim 10, wherein determining the brightness correction factor comprises retrieving data from a lookup table using the input duty cycle.

14. A backlit electronic display for an electronic device comprising:

a display panel configured to display an image;

a backlight device configured to provide a backlight to the display panel;

a backlight driver chip configured to receive data corresponding to a duty cycle, to determine a brightness correction factor to apply to the duty cycle to determine a corrected duty cycle, and to provide a current signal to drive the backlight device based at least partially on the corrected duty cycle, wherein correction circuitry comprises zone selection circuitry configured to receive the duty cycle, select a linearity factor zone based on the duty cycle; and determine the brightness correction factor based on the linearity factor zone; and the backlight driver chip is configured to limit the duty cycle based on a maximum duty cycle and a minimum duty cycle.

15. The electronic display of claim 14, wherein the backlight driver chip is configured to determine the brightness correction factor without receiving data other than the duty cycle from a device external to the backlight driver chip.

16. The electronic display of claim 14, wherein the backlight driver chip comprises a storage device configured to store a plurality of brightness correction factors.

17. A backlight driver chip for an electronic display of an electronic device comprising:

an input configured to receive data corresponding to a duty cycle;

correction circuitry configured to determine a brightness correction factor based at least partially on the duty cycle and to determine a corrected duty cycle based at least partially on the brightness correction factor, wherein the correction circuitry comprises zone selection circuitry configured to receive the duty cycle, select a linearity factor zone based on the duty cycle; and determine the brightness correction factor based on the linearity factor zone; and the correction circuitry is configured to limit the duty cycle based on a maximum duty cycle and a minimum duty cycle; and an output configured to provide a current signal for driving a backlight device, wherein the current signal is based at least partially on the corrected duty cycle.

18. The backlight driver chip of claim 17, wherein the correction circuitry is configured to determine the brightness correction factor using a lookup table.

19. The backlight driver chip of claim 17, wherein the correction circuitry is configured to determine the brightness correction factor using linear interpolation of a plurality of brightness correction factors.

* * * * *